US005208637A

United States Patent [19]

Landa

[11] Patent Number: 5,208,637

[45] Date of Patent: May 4, 1993

[54] LIQUID TONER REPLENISHMENT SYSTEM

[75] Inventor: Benzion Landa, Edmonton, Canada

[73] Assignee: Spectrum Sciences B.V., Wassenaar, Netherlands

[21] Appl. No.: 570,777

[22] Filed: Aug. 22, 1990

[51] Int. Cl.[5] ..... G03G 15/10

[52] U.S. Cl. ..... 355/256; 118/645; 118/659; 222/DIG. 1; 355/246; 355/260

[58] Field of Search ..... 355/256, 267, 260, 245, 355/246; 118/645, 659, 660; 222/56, 65, 66, 185, 390, DIG. 1

[56] References Cited

U.S. PATENT DOCUMENTS

| | | | |
|---|---|---|---|
| 2,349,726 | 5/1944 | Holler | 222/390 |
| 3,208,638 | 3/1963 | Frenzel et al. | 222/390 X |
| 3,242,881 | 3/1966 | Schafer | 222/390 X |
| 3,789,794 | 2/1974 | Smith et al. | 118/694 |
| 3,876,282 | 4/1975 | Schon et al. | 355/256 |
| 3,973,699 | 8/1976 | Cook | 222/108 |
| 4,281,620 | 8/1981 | McChesney et al. | 118/660 X |
| 4,306,671 | 12/1981 | Fisher | 222/390 X |
| 4,335,834 | 6/1982 | Zepkin | 222/390 X |
| 4,355,736 | 10/1982 | Schumacker et al. | 222/80 |
| 4,439,055 | 3/1984 | Landa | 355/307 |
| 4,579,253 | 4/1986 | Shenier | 222/DIG. 1 X |
| 4,800,839 | 1/1989 | Ariyama et al. | 118/645 X |
| 4,860,924 | 8/1989 | Simms et al. | 355/256 X |
| 4,953,755 | 9/1990 | Dennison | 222/146.5 |
| 5,027,984 | 7/1991 | Gakhar et al. | 222/390 X |

*Primary Examiner*—A. T. Grimley
*Assistant Examiner*—J. E. Barlow, Jr.
*Attorney, Agent, or Firm*—Sandler Greenblum & Bernstein

[57] ABSTRACT

Liquid toner imaging apparatus for producing an image on a substrate and having carrier liquid and toner particle carryout on the average in a first ratio, the apparatus including an image bearing surface, apparatus for developing an image on the image bearing surface using a liquid toner including carrier liquid and toner particles and apparatus for transferring a developed image from the image bearing surface to the substrate. The apparatus for developing includes a liquid toner reservoir, supply apparatus including a replaceable enclosure initially containing toner concentrate including carrier liquid and toner particles therein and having an opening communicating with the reservoir and replenishment apparatus for causing transfer of toner concentrate from the replaceable enclosure to the reservoir to replenish the toner and for causing transfer of contents of the reservoir to the replaceable enclosure to remove excess liquid toner from the reservoir.

26 Claims, 4 Drawing Sheets

LIQUID TONER REPLENISHMENT SYSTEM

FIELD OF THE INVENTION

The present invention relates generally to imaging systems and more particularly to liquid toner replenishment systems.

BACKGROUND OF THE INVENTION

Liquid toner compositions for use in liquid toner imaging systems normally comprise a carrier liquid and toner particles. These two components deplete at different rates from a liquid toner supply reservoir which is normally part of such systems. The relative component depletion rates are dependent on the percent coverage of the images produced by the imaging system and on other factors.

Imaging systems, be they printers or copiers, generally produce a variety of images having a wide range of print coverage. It is well known that the balance between the various components of a liquid toner can have a strong effect on the quality of printed images. Therefore most imaging systems have replenishment systems, which provide replenishment with toner concentrate, having a relatively high percentage of particles and also containing carrier liquid, and with carrier liquid free of toner particles. One or both of these replenishment components may have charge director added thereto, or charge director may be supplied in a separate charge director replenishment solution.

Toner concentrate is added whenever the liquid toner becomes depleted of toner particles. The concentration of toner particles may be determined by measuring the optical density of the liquid toner composition in the reservoir. Carrier liquid is supplied whenever the total amount of liquid toner in the reservoir falls below a certain level. Charge director may be added when the conductivity of the solution is reduced.

An exemplary system for the replenishment of liquid toner components is described in U.S. Pat. No. 4,860,924, the disclosure of which is incorporated herein by reference. The carrier liquid supply generally includes apparatus for the measurement of the liquid level in the reservoir, and a series of pumps and/or valves which are operated in response to a signal from the measurement apparatus to replenish the carrier liquid in the reservoir by pumping or otherwise transporting carrier liquid from the carrier liquid replenishment supply.

U.S. Pat. No. 3,789,794 describes a replenishment system including a dispenser container for paste-like toner concentrate which utilizes a piston to force the paste out of the container. Movement of the piston is caused by a fluid under pressure at the back of the piston.

U.S. Pat. No. 4,355,736 describes a container for dispensing liquid or paste as an aerosol, using a plunger whose movement is caused by compressed gas.

In multi-color electrophotography systems, liquid toners of different colors are required, each having associated therewith a separate replenishment system for toner particle concentrate and for carrier liquid, including separate measurement and supply apparatus. These separate systems add expense and complication and reduce reliability.

SUMMARY OF THE INVENTION

The present invention seeks to provide improved replenishment systems for liquid toner imaging apparatus.

It is a further object of some embodiments of the invention, to provide an imaging system without separate carrier liquid replenishment for each separate color.

There is thus provided in accordance with a preferred embodiment of the present invention, liquid toner imaging apparatus for producing an image on a substrate and having carrier liquid and toner particle carryout on the average in a first ratio, the apparatus including an image bearing surface, apparatus for developing an image on the image bearing surface using a liquid toner including carrier liquid and toner particles and apparatus for transferring a developed image from the image bearing surface to the substrate. The apparatus for developing includes a liquid toner reservoir, a supply apparatus initially containing toner concentrate, including carrier liquid and toner particles, therein and having an opening communicating with the reservoir and replenishment apparatus for causing transfer of contents of the supply apparatus to the reservoir to replenish the toner and for causing transfer of contents of the reservoir to the supply apparatus to remove excess liquid toner from the reservoir.

In a preferred embodiment of the invention the first ratio is smaller than the ratio of carrier liquid to toner particles in the toner concentrate. In a preferred embodiment of the invention the ratio of carrier liquid to toner particles in the liquid toner in the reservoir is larger than the first ratio.

Preferably the apparatus also includes measurement apparatus responsive to the ratio of carrier liquid to toner particles in the liquid toner in the reservoir and wherein the replenishment apparatus is operative to transfer a measured amount of toner concentrate from the supply apparatus to the reservoir responsive to the ratio of carrier liquid to toner particles in the liquid toner in the reservoir.

According to a preferred embodiment of the invention the supply apparatus includes a replaceable enclosure and the replenishment apparatus is operative to remove excess liquid toner from the reservoir before replacing the enclosure. In a preferred embodiment of the invention the replenishment apparatus is operative to transfer the contents of the enclosure to the reservoir when the enclosure is charged with toner concentrate and is operative for transferring liquid toner from the reservoir to the enclosure when the enclosure is effectively discharged of toner concentrate.

In a preferred embodiment of the invention the supply apparatus includes a dispensing container including an enclosure having a communication opening, rotary driven apparatus for causing egress of contents of the enclosure from the enclosure when rotated in a given sense, and engagement apparatus extending outside of the enclosure for receiving a rotary driving input from an external motive source and providing operation of the rotary driven apparatus. In a preferred embodiment of the invention the rotary driven means includes a piston mounted on an elongate screw drive.

In a preferred embodiment of the invention the engagement means comprises a gear arranged to drive the elongate screw drive and to be driven by an external gear drive in the electrophotography system.

In a further preferred embodiment of the invention there is provided liquid toner electrophotographic apparatus including an image bearing surface, apparatus for developing an image on the image bearing surface using a liquid toners including carrier liquid and pigmented particles, and apparatus for transferring a developed image from the image bearing surface to a substrate, wherein the apparatus for developing includes a liquid toner reservoir, an enclosure having an egress opening communicating with the reservoir, rotary driven apparatus for causing egress of contents of the enclosure when rotated in a given sense, engagement apparatus extending outside of the enclosure for receiving a rotary driving input and providing operation of the rotary driven apparatus and a motive source for providing the rotary driving input, operative in the given sense and also in an opposite sense for causing ingress of material to the enclosure.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
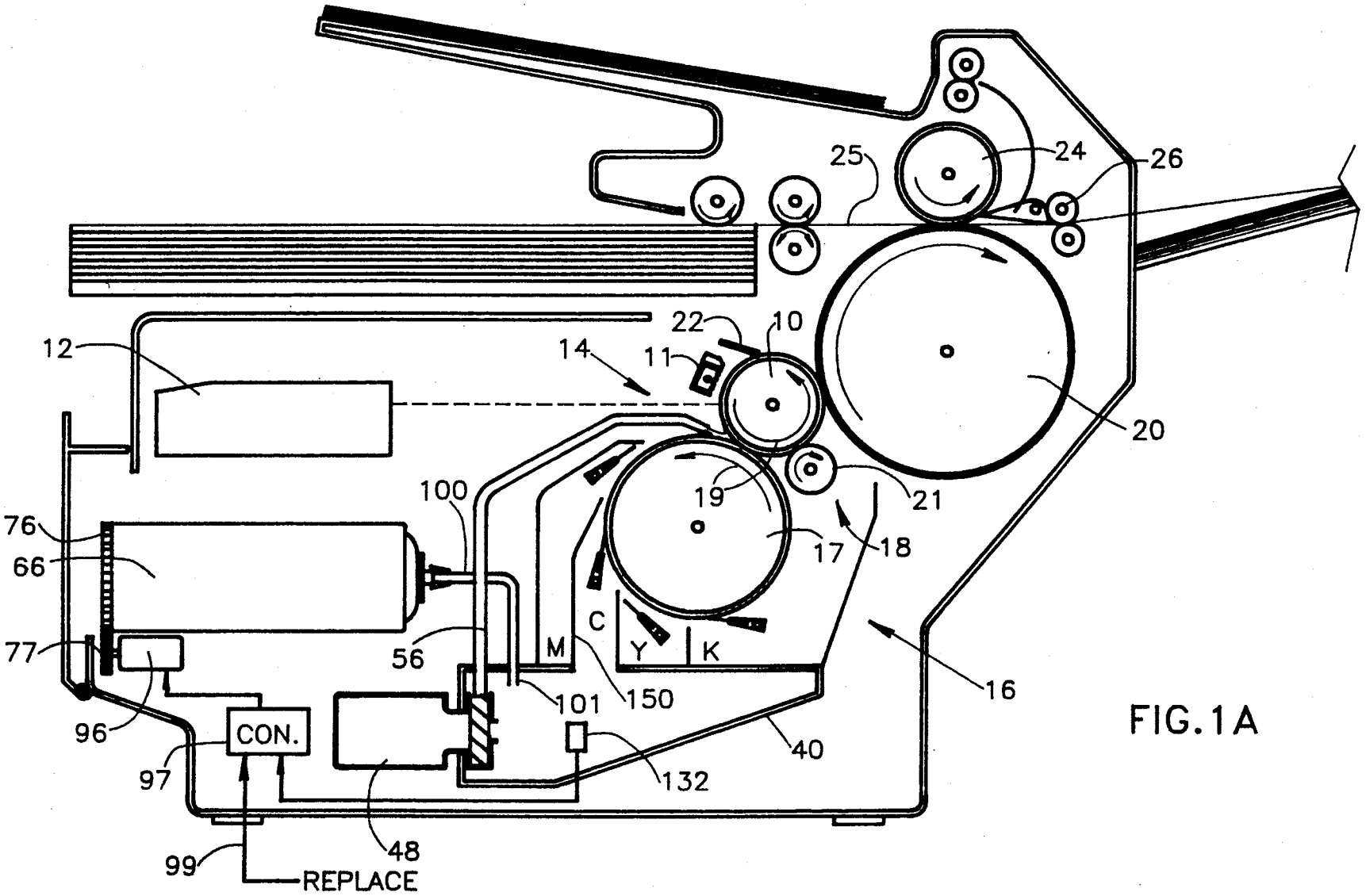
FIG. 1A is a side, partial sectional generalized illustration of multi-color imaging apparatus constructed and operative in accordance with a preferred embodiment of the present invention.
Figure 1B:
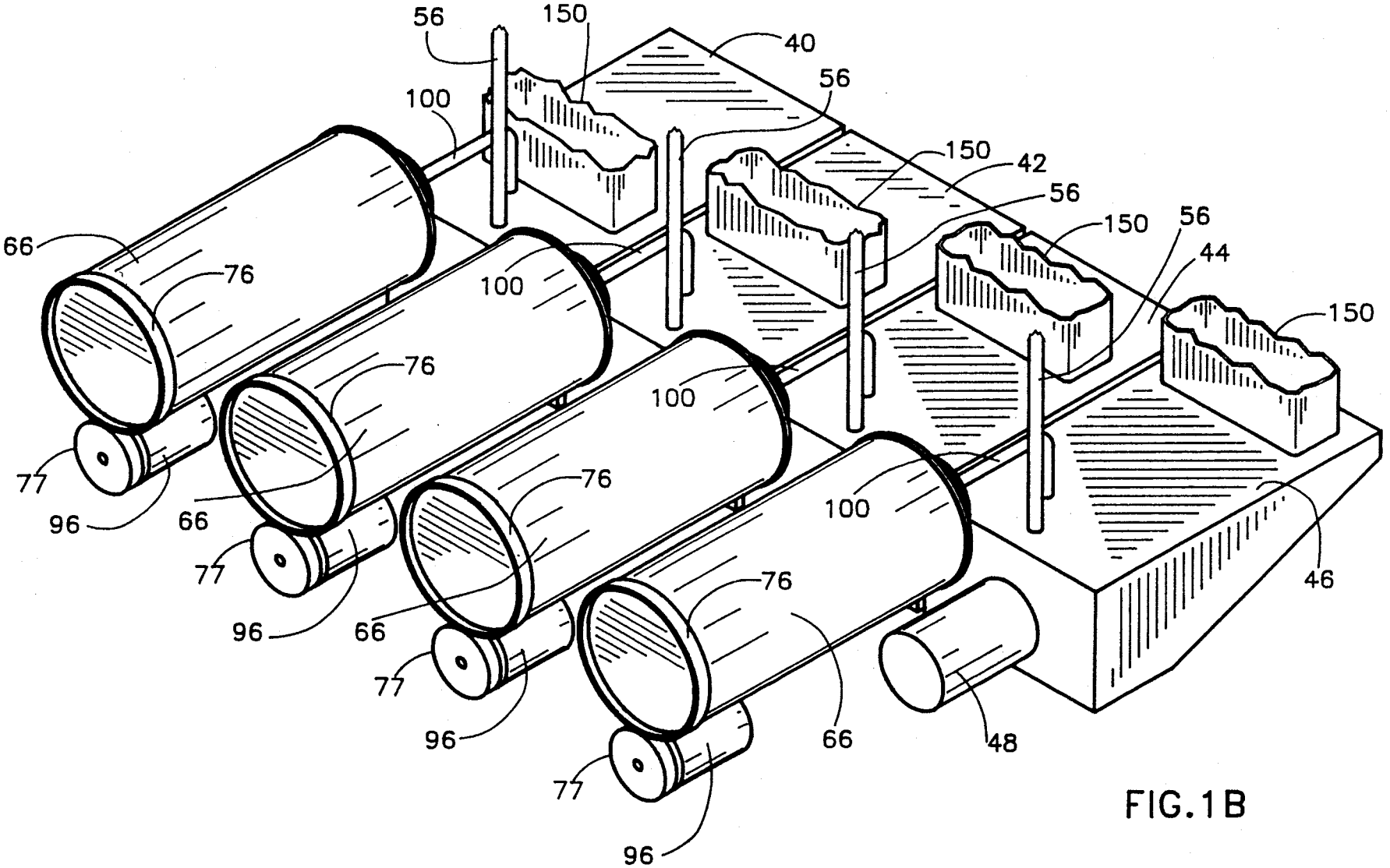
FIG. 1B is a partial perspective view of the apparatus of FIG. 1.

Reference is now made to FIGS. 1A and 1B which illustrate multicolor electrostatic imaging apparatus constructed and operative in accordance with a preferred embodiment of the present invention. As seen in FIGS. 1A and 1B, there is provided an image bearing surface typically embodied in a rotating photoconductive drum 10. Operatively associated with photoconductive drum 10 is photoconductor charging apparatus 11 and imaging apparatus 12, for example a laser scanner, for providing a desired latent image on drum 10. The latent image normally includes image areas at a first electrical potential and background areas at another electrical potential.

Also associated with photoconductive drum 10 are a multicolor liquid developing assembly 16, an excess liquid removal assembly 18, an intermediate transfer member 20 and a resilient scraper cleaning station 22.

Developing assembly 16 preferably includes a developer roller electrode 17 spaced from photoconductive drum 10 and typically rotating in the same sense as drum 10, as indicated by arrows 19. This rotation provides for the surface of drum 10 and roller 17 to have opposite velocities in their region of propinquity. Developing assembly also includes multicolor toner supply assembly 14, for providing colored toner to develop latent images on photoconductive drum 10.

The above-mentioned multicolor supply assembly 14 and liquid developer assembly 16 are described in greater detail in commonly assigned U.S. Patent Application entitled LIQUID DEVELOPER SYSTEM, which is being filed concurrently herewith. Alternative preferred liquid developer assemblies are described in commonly assigned PCT Patent Application Ser. No. PCT/NL90/00069, filed May 14, 1990, the disclosure of which is incorporated herein by reference.

Photoconductive drum 10, photoconductor charging apparatus 11 and imaging apparatus 12 may be any suitable drum, charging apparatus and imaging apparatus such as are well known in the art.

Excess liquid removal and image compacting assembly 18 typically includes a biased squeegee roller 21 which is urged against drum 10. Squeegee roller 21 is preferably formed of resilient slightly conductive polymeric material, and charged to a potential of several hundred to a few thousand volts with the same polarity as that of the charge on the toner particles.

Intermediate transfer member 20 may be any suitable intermediate transfer member such as those described in commonly assigned U.S. patent application Ser. Nos. 306,062 filed Feb. 6, 1989, and 393,649 filed Aug. 14, 1989, the disclosures of which are incorporated herein by reference, and is arranged for electrophoretic transfer of the image thereto from the image bearing surface. Intermediate transfer member 20 is preferably associated with a pressure roller 24 for subsequent transfer of the image onto a further substrate 25, such as paper, preferably by heat and pressure. A fuser 26 may be associated with substrate 25, for fixing the image thereon, if further fixing is required.

Cleaning station 22 may be any suitable cleaning station such as the resilient blade shown in FIG. 1 or that described in U.S. Pat. No. 4,439,035, the disclosure of which is incorporated herein by reference.

In accordance with one embodiment of the invention, after development of each image in a given single color, the single color image is transferred to intermediate transfer member 20. Subsequent images in different colors are sequentially transferred onto intermediate transfer member 20. When all of the desired images have been transferred to intermediate transfer member 20, the complete multi-color image is transferred from transfer member 20 to substrate 25. Pressure roller 24 therefore produces operative engagement between intermediate transfer member 20 and substrate 25 only when transfer of the composite image to substrate 25 takes place.

Alternatively, each single color image is transferred to the paper after its formation. In this case the paper is fed through the machine once for each color or is held on a platen (not shown) and contacted with intermediate transfer member 20 during image transfer. As a further alternative, the intermediate transfer member 20 is omitted and the developed single color images are transferred sequentially directly from drum 10 to substrate 25.

Multicolor toner supply assembly 14, receives separate supplies of colored toner from four different reservoirs 40, 42, 44 and 46, typically containing Yellow, Magenta, Cyan and Black liquid toners respectively. Pumps 48 may be provided at the entrances of respective supply conduits 56, for providing a desired amount of pressure to feed the colored toner to multicolor supply assembly 14.

An exemplary preferred toner for use in the invention is the toner described in Example 1 of U.S. Pat. No. 4,794,651, the disclosure of which is incorporated herein by reference. For color toners the carbon black is replaced by color pigments as is well known in the art. Other liquid toners are also suitable for use in the invention.

Charge director as is known in the art is added to charge the toner particles. Preferably the charge directors described in commonly assigned U.S. patent application Ser. No. 7/354,121 filed May 22, 1989, the disclosure of which is incorporated herein by reference, are used.

In an alternative preferred embodiment of the invention the charge directors disclosed in commonly assigned U.S. patent application Ser. No. 7/533,765 which was filed on Jun. 6, 1990, the disclosure of which is incorporated herein by reference, are used. These charge directors have the unusual characteristic that the charge director is associated only with the toner particles and none of the charge director is dissolved in the carrier liquid.

Associated with each of reservoirs 40, 42, 44 and 46 are typically provided containers 66 of concentrated toner material. In accordance with a preferred embodiment of the invention, containers 66 are constructed and operative as described hereinbelow with reference to FIGS. 1A, 1B, 2, 3A and 3B.

Each container preferably comprises a housing 70 constituting an enclosure, axially of which is disposed an elongate screw 72. Arranged for axial movement in housing 70 is a piston 74, which is threaded so as to move axially in response to rotation of screw 72. Rotational motion of screw 72 is provided by a gear 76, which is mounted externally of housing 70 and fixedly attached to screw 72.

Figure 2:
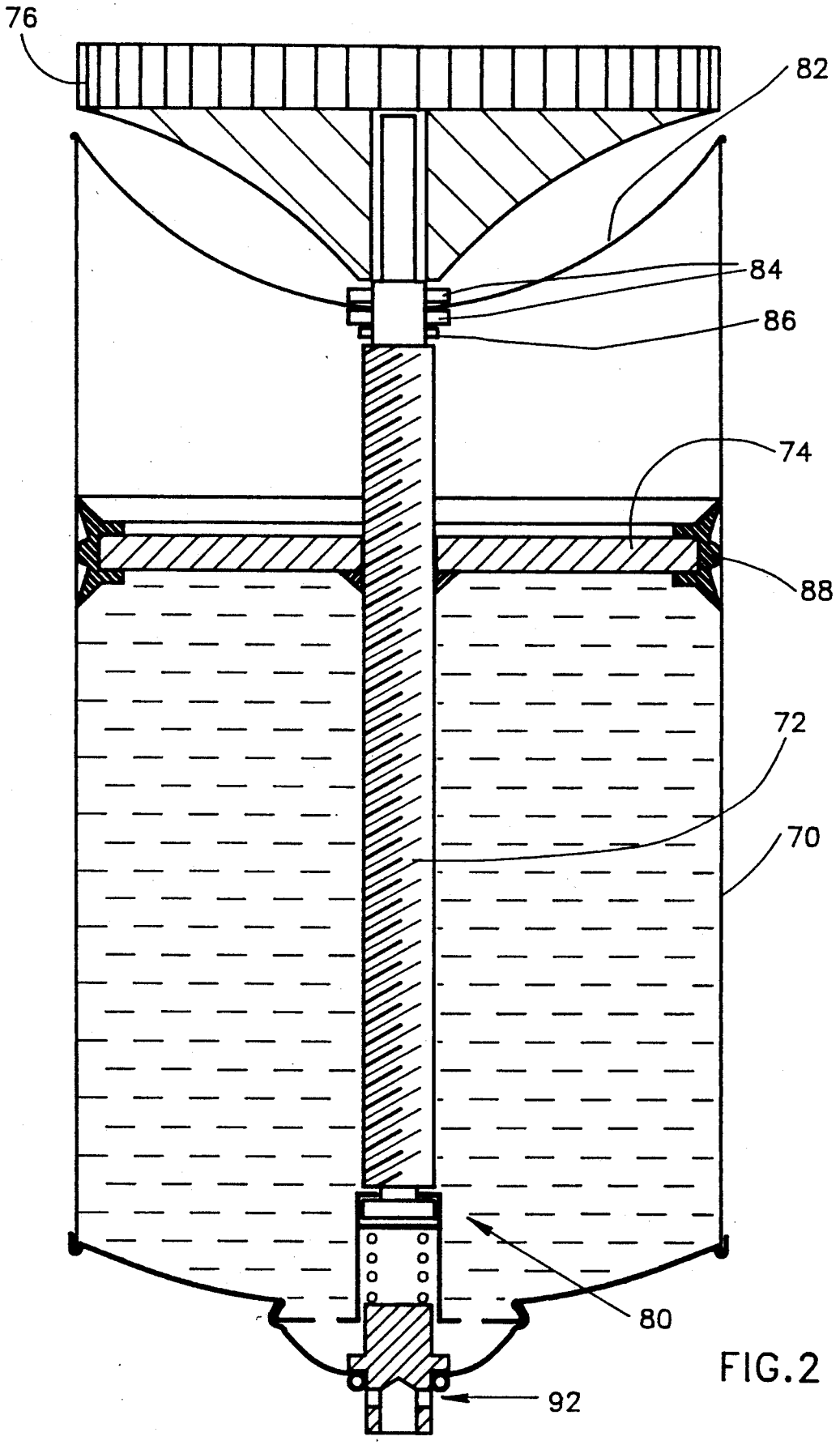
FIG. 2 is a simplified side sectional illustration of a container constructed and operative in accordance with a preferred embodiment of the invention.

Preferably screw 72 is mounted inside housing 70 on a centering bearing 80 and extends through a wall 82 of housing 70, being sealed with washers 84 and a retaining ring 86. Preferably piston 74 is provided with a peripheral seal 88, typically formed of rubber. Preferably housing 70, defines at the end of housing 70 axially opposite to wall 82, a communication valve 92, which is normally closed, except when mounted in the imaging system. As can be seen in FIG. 2, a compartment containing toner concentrate is defined by housing 70, piston 74 and wall 90.

Figure 3A:
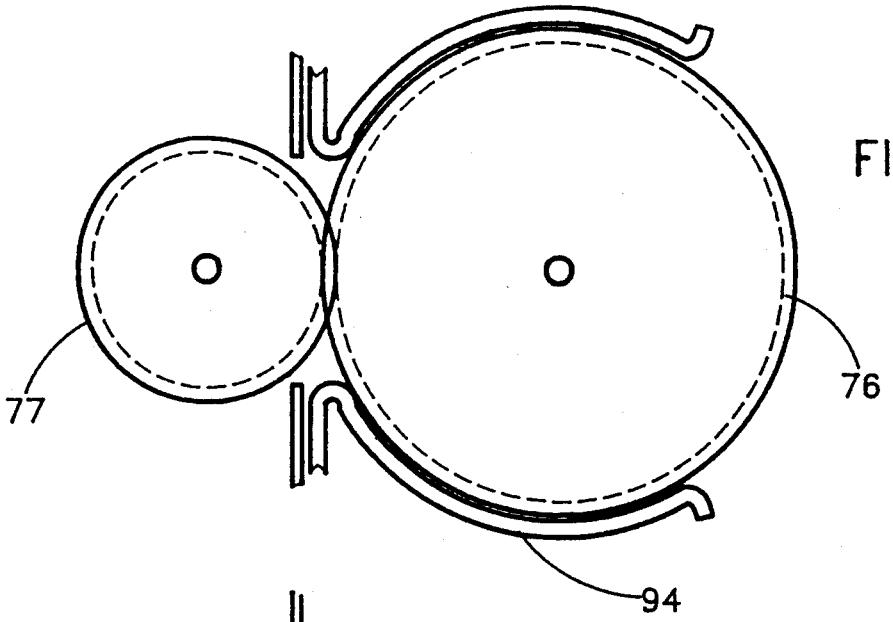
FIG. 3A is a side view of the mounting of the container of FIG. 2 in an imaging system system, such as that shown in FIGS. 1A and 1B.
Figure 3B:
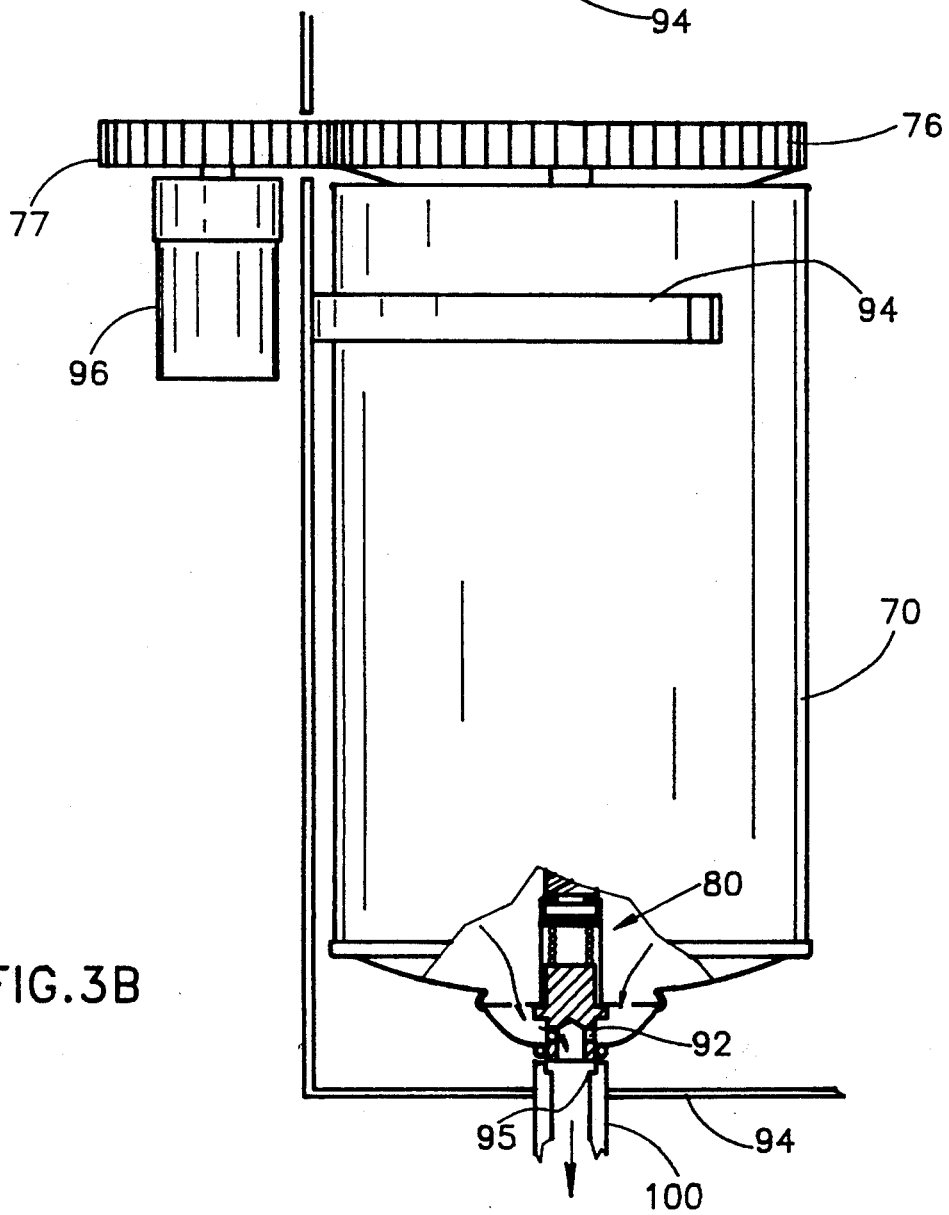
FIG. 3B is a top, partial sectional view of the mounting of the container of FIG. 2 in an imaging system, such as that shown in FIGS. 1A and 1B.

Mounting and operation of the apparatus of FIG. 2 can be seen from a consideration of FIGS. 3A and 3B, wherein a mounting bracket 94 of any suitable form is employed for desired mounting of the container and a gear motor 96 is operatively connected to gear 76 via gear 77 for driving gear 76 in a desired direction. When it is so mounted, a portion 95 of bracket 94, pushes valve 92 open, allowing for flow of toner concentrate from the interior of the container.

It will be appreciated that operation of gear motor 96 in one direction produces axial motion of piston 74 in a direction toward valve 92, thus producing measured egress of toner material from the container, typically via a conduit 100 to a respective liquid toner reservoir such as reservoir 42. Operation of gear motor 96 in an opposite direction, produces axial motion of piston 74 in a direction away from valve 92, thus-producing ingress of material to the container via conduit 100 from the respective toner reservoir.

In general, concentrates of the preferred toner material have a very high viscosity, and it is necessary to provide substantial pressure on the concentrate to remove it from container 66. In the preferred embodiment hereinabove described, valve 92 is normally closed during shipment of the container and is always open when the can is installed in the machine. There is no propellant in the can and the concentrate will not be forced out of the can if the valve is accidentally pushed in.

It is appreciated that other structures for providing driven movement of toner materials from a container and possibly also into a container may be provided within the scope of an embodiment of the present invention.

In a preferred embodiment of the invention, the toner concentrate is provided at a toner particle to carrier liquid concentration somewhat lower than the toner particle to carrier liquid concentration in the average carryout from the system, but at a higher concentration than that of toner particles in the liquid developer. That is to say, if in normal printing operation, the ratio of toner particles to carrier liquid carried out of the system is, for example, 1:3 (i.e., 25% toner particle concentration on the average), and the concentration of toner particles in the liquid toner is 1.5%, then a concentration of toner particles in the compartment of 20% would be appropriate. It should be understood that the concentration of toner particles in container 66 may in a preferred embodiment of the invention, have any value between the concentration of particles iu the liquid toner and that in the total material carried out of the system.

When the relationship of the concentrations of the toner concentrate, material carryout and toner particle concentration in the developer is as given above, a liquid toner imaging system, having no separate carrier liquid replenishment, may be provided in a preferred embodiment of the invention.

In operation a measurement responsive to the concentration of toner particles in liquid toner in the respective reservoir is performed preferably by measurement of the optical density of the liquid toner by an optical detector 132. When the density is below a first predetermined level, motor 96 is activated by controller 97 to add a measured amount of toner concentrate from container 66 to the respective toner reservoir thereby to increase the toner particle concentration to the required level. Since the proportion of toner particles in container 66 is less than that carried out from the reservoir, an excess of carrier liquid is added to the reservoir over that removed by printing. This will cause the liquid level in the tank to rise slightly each time toner concentrate is added.

When container 66 is empty, motor 96 is reversed, either in response to a manual signal 99 from the operator or preferably in response to a measurement of optical density below a second predetermined level, which is lower than the first predetermined level. Alternatively, controller 97 can count the number of turns of the gear, and reverse the motor when a number which empties the container is reached. Any liquid toner then present in the reservoir, above the level of outlet 101 of conduit 100, is transferred from the reservoir to container 66.

This removal of excess liquid developer from reservoir 42 leaves a desired amount of liquid toner in the reservoir.

Container 66 is then replaced by a fully charged container and the cycle repeats itself.

An important advantage of the system as described is that there is no need for a separate supply of carrier liquid as in conventional liquid toner systems. The carrier liquid is replenished together with the toner particles. Nor is there any danger of overflow caused by excess carrier liquid addition since excess carrier liquid provided with the concentrate is removed with the spent concentrate container.

This allows for a relatively simple supply system which can provide relatively maintenance free operation of the system of the apparatus over relatively long periods of time without addition of carrier liquid.

The optical density of each of the colored toner dispersions is preferably separately measured by an optical density measurement circuit 132. Exemplary forms of such apparatus are shown in U.S. Pat. Nos. 4,579,253 or 4,860,924, the disclosures of which are incorporated herein by reference. A signal responsive to the density is fed into a toner dispenser control system 97 which is operative to activate the motor and to dispense a given amount of toner concentrate from containers 66 into the specific reservoir.

Charge director is preferably included with the toner concentrate in a proper amount. If one of the charge directors of the above mentioned U.S. patent application Ser. No. 7/533,765, is used then no additional replenishment of charge director is believed necessary. On the other hand if the charge director of U.S. patent application Ser. No. 7/354,121 or conventional charge directors is used then additional replenishment of charge director may be required. In this case conductivity measuring apparatus is provided in each reservoir to determine a low conductivity condition. If a low conductivity condition exists, then a measured amount of charge director solution is added to the specific reservoir. U.S. Pat. No. 4,860,924, the disclosure of which is incorporated herein by reference, shows exemplary apparatus for carrying out the charge director replenishment function.

Each of reservoirs 40, 42, 44 and 46 also typically receives an input of recycled toner of a corresponding color from developer assembly 16, via conduits 150.

It will be appreciated by persons skilled in the art that the present invention is not limited to what has been particularly shown and described hereinabove. Rather the scope of the present invention is defined only by the claims which follow:

I claim:

1. Liquid toner imaging apparatus for producing an image on a substrate and having toner particle and carrier liquid carryout on the average in a first ratio, the apparatus comprising:

an image bearing surface;

means for developing an image on the image bearing surface using a liquid toner including carrier liquid and toner particles; and means for transferring a developed image from the image bearing surface to the substrate, wherein the means for developing comprises:

a liquid toner reservoir;

supply apparatus comprising a replaceable container having an enclosure, including a compartment initially containing toner concentrate including carrier liquid and toner particles, the compartment having an opening communicating with the reservoir; and replenishment means for causing transfer of toner concentrate from the compartment to the reservoir to replenish the toner and for causing transfer of contents of the reservoir to the compartment to remove excess liquid toner from the reservoir.

2. Apparatus according to claim 1 wherein the first ratio is larger than the ratio of toner particles to carrier liquid in the toner concentrate.

3. Apparatus according to claim 1 wherein the ratio of toner particles to carrier liquid in the reservoir is smaller than the first ratio.

4. Apparatus according to claim 3 and also comprising measurement means responsive to the ratio of carrier liquid to toner particles in the liquid toner in the reservoir and wherein the replenishment means is operative to transfer a measured amount of toner concentrate from the compartment to the reservoir, responsive to the ratio of carrier liquid to toner particles in the liquid toner in the reservoir.

5. Apparatus according to claim 1 wherein the replenishment means is operative to remove excess liquid toner from the reservoir before replacing the replaceable container.

6. Apparatus according to claim 1 wherein the replenishment means is operative to transfer the contents of the compartment to the reservoir when the replaceable container is charged with toner concentrate and is operative for transferring liquid toner from the reservoir to the compartment when the replaceable container is effectively discharged of toner concentrate.

7. Apparatus according to claim 1 wherein the replaceable container comprises:

a single communication opening to the compartment;

rotary driven means for causing egress of contents of the enclosure from the compartment when rotated in a given sense; and engagement means extending outside of the enclosure for receiving a rotary driving input from an external motive source and providing operation of the rotary driven means.

8. Apparatus according to claim 7 wherein the rotary driven means includes a piston mounted on an elongate screw drive.

9. Apparatus according to claim 7 wherein the engagement means comprises a gear arranged to drive an elongate screw drive an to be driven by an external gear drive in the electrophotography system.

10. Liquid toner imaging apparatus comprising:

an image bearing surface;

means for developing an image on the image bearing surface using a liquid toner including carrier liquid and pigmented particles; and means for transferring a developed image from the image bearing surface to a substrate, wherein the means for developing comprises:

a liquid toner reservoir;

an enclosure having an egress opening communicating with the reservoir;

rotary driven means for causing egress of contents of the enclosure when rotated in a given sense;

a motive source operative to rotate the rotary driven means in the given sense thereby causing transfer of toner concentrate from the enclosure and also in an opposite sense thereby causing transfer of excess liquid toner from the reservoir to the enclosure.

11. Apparatus according to claim 10 the rotary driven means includes a piston mounted on an elongate screw drive.

12. Apparatus according to claim 11 and including a gear arranged to drive the elongate screw drive and to be driven by an external gear drive in the electrophotography system.

13. Liquid toner imaging apparatus for producing an image on a substrate wherein toner particles and carrier liquid are removed from the system on the average in a first ratio, the apparatus comprising:

an image bearing surface;

means for developing an image on the image bearing surface using a liquid toner including carrier liquid and toner particles; and means for transferring a developed image from the image bearing surface to the substrate, wherein the means for developing comprises:

a liquid toner reservoir;

supply apparatus comprising a replaceable container initially containing toner concentrate, including toner particles and carrier liquid, in a ratio smaller than said first ratio, therein and having an opening communicating with the reservoir; and replenishment means for causing transfer of toner concentrate from the replaceable container to the reservoir, without causing overflow of liquid in said reservoir, to replenish the toner.

14. Apparatus according to claim 13 wherein said replenishment means also includes means for causing transfer of contents of the reservoir to the replaceable container to remove excess liquid toner from the reservoir.

15. Apparatus according to claim 13 wherein the replenishment means is operative to remove excess liquid toner from the reservoir before replacing the replaceable container.

16. Apparatus according to claim 13 wherein the ratio of toner particles to carrier liquid in the reservoir is smaller than the first ratio.

17. Apparatus according to claim 16 and also comprising measurement means responsive to the ratio of carrier liquid to toner particles in the liquid toner in the reservoir and wherein the replenishment means is operative to transfer a measured amount of toner concentrate from the replaceable container to the reservoir, responsive to the ratio of carrier liquid to toner particles in the liquid toner in the reservoir.

18. Apparatus according to claim 13 wherein the replenishment means is operative to transfer the contents of the replaceable container to the reservoir when the replaceable container is charged with toner concentrate and is operative for transferring liquid toner from the reservoir to the replaceable container when the replaceable container is effectively discharged of toner concentrate.

19. Apparatus according to claim 13 wherein the replaceable container comprises:

an enclosure comprising a single chamber containing said toner concentrate and having a communication opening;

rotary driven means for causing egress of contents of the chamber from the chamber when rotated in a given sense; and engagement means extending outside of the enclosure for receiving a rotary driving input from an external motive source and providing operation of the rotary driven means.

20. Apparatus according to claim 19 wherein the rotary driven means includes a piston mounted on an elongate screw drive.

21. Apparatus according to claim 19 wherein the engagement means comprises a gear arranged to drive an elongate screw drive and to be driven by an external gear drive in the imaging apparatus.

22. A disposable dispensing container for toner materials for use in a liquid toner imaging system and comprising:

an enclosure comprising a single compartment containing liquid toner concentrate and an opening communicating with said chamber; and means for causing egress of liquid toner concentrate from said chamber to the liquid toner imaging system through said opening a first mode of operation and ingress of liquid toner material into the chamber from the liquid toner imaging system through said opening in a second mode of operation.

23. Apparatus according to claim 25 wherein the means for causing egress and ingress comprises:

rotary driven means for causing egress of contents of the enclosure from the chamber when rotated in a given sense and for causing ingress of material into the chamber when the enclosure is rotated in the opposite sense; and engagement means extending outside of the enclosure for receiving a rotary driving input from an external motive source and providing operation of the rotary driven means.

24. A method for producing an image on a substrate utilizing a liquid toner imaging apparatus having toner particle and carrier liquid carryout on the average in a first ratio, the apparatus comprising an image bearing surface, a liquid toner reservoir which supplies liquid toner to the image bearing surface for developing an image thereon, and a replaceable container having an enclosure including a compartment initially containing toner concentrate and having an opening communicating with the reservoir, including the steps of:

a) transferring toner concentrate from the compartment to the reservoir to replenish the toner therein; and b) transferring excess liquid toner from the reservoir to the compartment.

25. The method of claim 24 wherein the first ratio is larger than the ratio of toner particles to carrier liquid in the toner concentrate.

26. The method of claim 24 and comprising the step of substantially discharging the contents of the compartment before performing the step of transferring excess liquid toner.

* * * * *

UNITED STATES PATENT AND TRADEMARK OFFICE

CERTIFICATE OF CORRECTION

PATENT NO. : 5,208,637

DATED : May 4, 1993

INVENTOR(S) : B. LANDA

It is certified that error appears in the above-indentified patent and that said Letters Patent is hereby corrected as shown below:

On the cover, page [56], under United Stated Patent Documents, line 11, change "4,439,055" to ---4,439,035---.

At column 3, line 35, delete "system" (second occurrence).

At column 8, line 44 (claim 9, line 3), change "an" (first occurrence) to ---and---.

At column 10, line 27 (claim 23, line 1), change "25" to ---22---.

Signed and Sealed this

Seventeenth Day of October, 1995

Bruce Lehman

*Attest:*

BRUCE LEHMAN

*Attesting Officer*

*Commissioner of Patents and Trademarks*